US005726378A

United States Patent [19]

Barrett

[11] Patent Number: 5,726,378

[45] Date of Patent: Mar. 10, 1998

[54] UNITARY PROPELLANT CHARGE FOR MUZZLE LOADING FIREARMS

[75] Inventor: G. Dean Barrett, Kansas City, Mo.

[73] Assignee: Hodgdon Powder Company, Inc., Shawnee Mission, Kans.

[21] Appl. No.: 625,938

[22] Filed: Apr. 1, 1996

[51] Int. Cl.[6] ..... C06D 5/06; F42B 5/18

[52] U.S. Cl. ..... 102/288; 102/431; 102/700

[58] Field of Search ..... 102/288, 431–3, 102/700

[56] References Cited

U.S. PATENT DOCUMENTS

| | | | |
|---|---|---|---|
| 321,042 | 6/1885 | Lyman | 102/38 |
| 2,575,871 | 11/1951 | Gordon et al. | 102/98 |
| 2,632,391 | 3/1953 | Kintzinger | 102/38 |
| 3,008,258 | 11/1961 | Johnson | 42/14 |
| 3,396,661 | 8/1968 | Michael | 102/103 |
| 3,398,684 | 8/1968 | Kvavle | 102/49.3 |
| 3,513,776 | 5/1970 | Driscoll | 102/38 |
| 3,557,700 | 1/1971 | Quinlan et al. | 102/38 |
| 3,648,616 | 3/1972 | Hsu | 102/40 |
| 3,670,649 | 6/1972 | Hartlein et al. | 102/38 |
| 3,754,510 | 8/1973 | Marondel et al. | 102/101 |
| 3,901,153 | 8/1975 | Brabets et al. | 102/38 |
| 3,994,235 | 11/1976 | Politzer et al. | 102/101 |
| 4,128,443 | 12/1978 | Pawlak et al. | 149/71 |
| 4,187,781 | 2/1980 | Flanagan et al. | 102/38 CC |
| 4,282,813 | 8/1981 | Sterbutzel | 102/431 |
| 4,497,676 | 2/1985 | Kurtz | 149/2 |
| 4,702,167 | 10/1987 | Reinelt et al. | 102/282 |
| 4,724,017 | 2/1988 | Eich et al. | 149/11 |
| 4,728,376 | 3/1988 | Kurtz | 149/21 |
| 4,759,885 | 7/1988 | Kurtz | 264/3.1 |
| 4,864,932 | 9/1989 | Reinelt et al. | 102/282 |
| 4,964,929 | 10/1990 | Beyeler et al. | 149/109.6 |
| 4,994,203 | 2/1991 | Lefumeux et al. | 102/431 X |
| 4,997,496 | 3/1991 | Wehrli | 149/18 |
| 5,063,851 | 11/1991 | Moscrip | 102/433 |
| 5,133,240 | 7/1992 | Thiesen et al. | 86/20.14 |
| 5,269,224 | 12/1993 | Gonzales et al. | 102/288 |
| 5,282,423 | 2/1994 | Sikorski et al. | 102/431 |
| 5,421,264 | 6/1995 | Petrick | 102/443 |
| 5,449,423 | 9/1995 | Cioffe | 149/19.1 |
| 5,465,664 | 11/1995 | Fey | 102/290 |
| 5,569,875 | 10/1996 | Fey | 149/61 |

OTHER PUBLICATIONS

"Handloading with precision" by Dynamit Nobel, 1979.
"Advanced Combat Rifle" by AAI Corporation, 1994.

*Primary Examiner*—Peter A. Nelson
*Attorney, Agent, or Firm*—Kokjer, Kircher, Bowman & Johnson

[57] ABSTRACT

A preformed unitary pellet formed from an appropriate propellant for use in muzzle loading firearms. Particular formulations, dimensions, densities, and other parameters for specific applications are set forth. A method of manufacture is also included.

9 Claims, 1 Drawing Sheet

UNITARY PROPELLANT CHARGE FOR MUZZLE LOADING FIREARMS

FIELD OF THE INVENTION

This invention relates generally to propellant charges for muzzle loading firearms and is directed more particularly to a unitary propellant pellet generally suited for use in charging muzzle loading sporting guns. Among a host of other advantages, this invention improves the convenience and consistency of measuring the powder charge, reduces the likelihood of spilled powder, insures consistent compaction of the charge, increases the speed of loading and eliminates the need for powder flasks, powder measurers and related accessories which are conventionally employed in shooting muzzle loaders.

BACKGROUND OF THE INVENTION

Loading, or charging, propellants into muzzle loading guns has long presented problems. The propellant, either blackpowder or a substitute therefor, has been handled in granular form, with each charge being determined by measuring out a selected weight or volume of the propellant from a bulk supply, delivering it to the bore of the gun, placing a projectile in the bore, and seating the charge by ramrod into the breech. The charging of this propellant thus requires special tools and implements which must be carried to the field of use and kept readily available for re-loading. In addition, there is always the risk of mismeasurement and spillage of loose powder. Other problems exist. It is difficult to obtain uniform powder compaction from load to load. It is difficult to re-load with speed and accuracy.

Many of the foregoing problems can be avoided or at least partially eliminated by forming powder granules into compacted pellets of pre-determined size which will equal, or compose a fraction of, a suitable charge. Clearly, however, the successful replacement of a charge made up of a measured quantity of loose powder requires something more than simply compacting the powder into a solid propellant body.

SUMMARY OF THE INVENTION

My invention provides a preformed unitary pellet which has proven in testing to offer a viable alternative, from the standpoint of safe handling, loading, and ballistic performance, to the conventional powder charge. I provide a solid propellant pellet which is capable of being loaded as a safe, proper charge into the barrel of the gun and seated with a minimum of effort while avoiding jamming the flash channel of the gun with combustion residues from previous firings. No powder is spilled during the loading process and speed of loading is increased.

Another advantage in using my pellet is that a consistent amount of powder is used for each shot. Powder compaction is constant from pellet to pellet, thus giving consistent ballistic results. In addition, through the special design of my pellet, it is possible to combine related powders in a single pellet to take advantage of the desirable features of each. Finally, my pellet is designed to give good ignition and complete combustion when my pellet is properly used.

Other and further objects of the invention, together with the features of novelty appurtenant thereto, will appear in the course of the following description.

DETAILED DESCRIPTION

In the accompanying drawings which form a part of the specification and are to be read in conjunction therewith and in which like reference numerals are used to indicate like parts in the various views.

Figure 1:
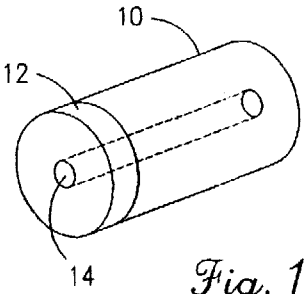
FIG. 1 is a perspective view of a preferred embodiment of a pellet according to the invention.
Figure 2:
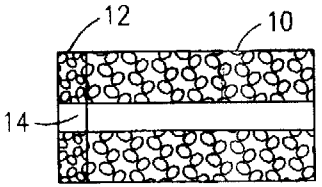
FIG. 2 is a longitudinal section taken through the longitudinal axis of the pellet.

Referring now initially to FIGS. 1 and 2, the preferred embodiment of the pellet comprises a cylindrical body 10 compounded principally of compacted granules of a blackpowder substitute commonly known under the trademark Pyrodex®. As used throughout the specification and claims, the term Pyrodex refers to a propellant characterized chemically as a pyrotechnic mixture. The general composition of Pyrodex® is described in U.S. Pat. No. 4,128,443, issued Dec. 5, 1978, titled "Deflagrating Propellant Compositions", the disclosure of which is incorporated herein by reference and made a part hereof.

Formed on one end of the main body 10 of the pellet is an ignition pad 12 which is compacted with and bound by compaction to the main body. The pad 12 is formed of a propellant different from, and faster burning, than that of the main body. The preferred composition of the pad 12 is blackpowder, which, known to those skilled in the art, is an intimate mixture of potassium nitrate, sulfur and charcoal.

The pellet is formed with an axial open bore 14 extruding completely from one end face of the pellet to the other. In other words, the bore 14 runs the entire longitudinal axis of both blackpowder pad 12 and Pyrodex main body 10.

Figure 3:
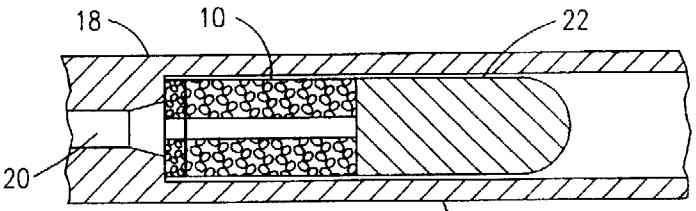
FIG. 3 is a sectional view of a gun barrel with the pellet constructed in accordance with this invention placed within the bore thereof and a projectile in place on top of the pellet.

The pellet is designed to be used singly, or in stacked multiples, as a propellant charge for muzzle loading firearms, as generally illustrated in FIG. 3, wherein a portion of the gun barrel is shown at 16, the breech at 18 and the flash channel for the gun at 20. A typical projectile is illustrated at 22.

The pellet must be dimensioned to fit a particular caliber of firearm so that it can be introduced at the discharge end of the muzzle and allowed to drop by gravity into position in the breech. To this end, the maximum outside diameter of the pellet needs to be held within rather strict tolerances. It must be of optimum cross-sectional area to obtain the desired projectile velocity, yet be able to travel freely down the bore and reach the seated breech position without scraping or pushing combustion residue in the bore ahead of the pellet into the flash channel of the gun. In addition, it is desirable that the pellet burn on the exterior surface. I have determined that a main pellet diameter of a range of approximately 0.005" to 0.100" less than the effective diameter of the gun bore achieves the desired results, with a nominal pellet diameter of 0.050" less than the nominal bore diameter preferred.

The length of the pellet is controlled primarily by the size of the charge of propellant required for achieving the desired velocity for a given projectile, taking into account the other controlling amounts such as diameter of the pellet, volume of the pellet, bore size, and density of compaction. The maximum propellant content is controlled by the safe limits of the firearm in which it is to be used. In general, muzzle loader manufacturers use a maximum level of the equivalent to 100 grains by weight of blackpowder. I prefer a pellet which approaches 50% of the maximum charge. This permits the use of one pellet for miscellaneous shooting and two pellets for hunting. As an example, using Pyrodex® as the base constituent for the pellet, and blackpowder for the ignition pad, and using a pellet hole diameter of 0.125" and a density of 333 grains/cu. in. the dimensions and content for a pellet for a 50 caliber gun are Length=0.750" nominal Diameter=0.450" nominal Grains of Powder=Pyrodex 32 grains by weight; blackpowder 5 grains by weight The grain content of the ignition pad 12 is primarily controlled by the particular gun for which the pellet is intended for use and may be varied based on empirical studies.

Pellet density is a vital consideration in the ballistic performance and structural strength of the pellet. Low pellet density results in high rate of combustion and poor structural strength. While high rate of combustion may be desirable, it cannot be achieved at the expense of pellet durability. With poor pellet structural strength, the pellet may break during shipping and handling or when the projectile is seated upon it in the gun barrel. If it does break in the barrel, a faster burning rate will occur and the projectile velocity will not be consistent with that resulting from the combustion of an unbroken pellet.

On the other hand, high density results in a low rate of combustion, more difficult ignition, and good structural strength. While good structural strength is necessary, it cannot be achieved at the expense of low rate of combustion and more difficult ignition. High pellet density can cause incomplete combustion of the pellet while it is resident in the gun barrel, and burning pellet fragments can exit the gun barrel. Poor projectile velocity is also a characteristic of high pellet density.

Pellet density thus must be chosen with care. For this exampled a pellet density of 333 grains/cu. in. produces good, consistent ballistic results and provides a pellet with adequate structural strength.

Density, moisture content, and pellet configuration all play a part in pellet strength. For the preferred embodiment, I have used a moisture content of 1.5% and a configuration which embodies an axial hole. Within the parameters of the preferred embodiment, I have determined approximate limits for pellet density. The minimum density below which the pellet has insufficient structural strength is approximately 320 grains/cu. in. Above approximately 410 grains/cu. in., the burning rate of the pellet is sufficiently retarded to possibly cause portions of the pellet to exit the muzzle before the pellet is totally combusted.

The diameter of the hole or bore 14 through the pellet is also a variable. It must be sufficiently large enough to create a flame path resulting in burning of the pellet radially as well as axially. However, the hole diameter also must be limited so as to preserve a cross-sectional area for the pellet which provides a propellant volume that does not require undue length of the pellet. Further, the hole diameter must be such as to be achievable without creating problems in manufacture. A diameter of approximately 0.125" is preferred.

Figure 6:
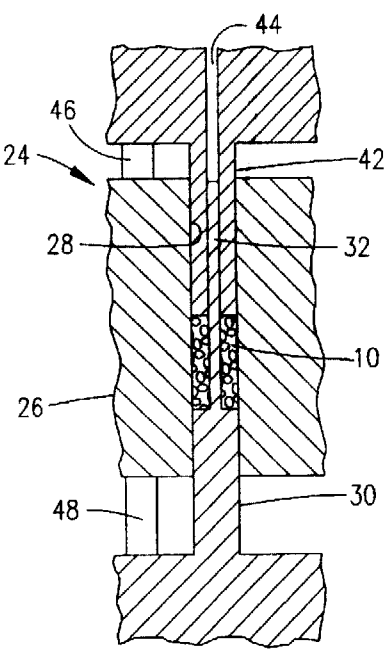
FIG. 6 is a schematic sectional view similar to FIG. 5 but showing the pellet and associated forming components at the completion of the compaction step.
Figure 5:
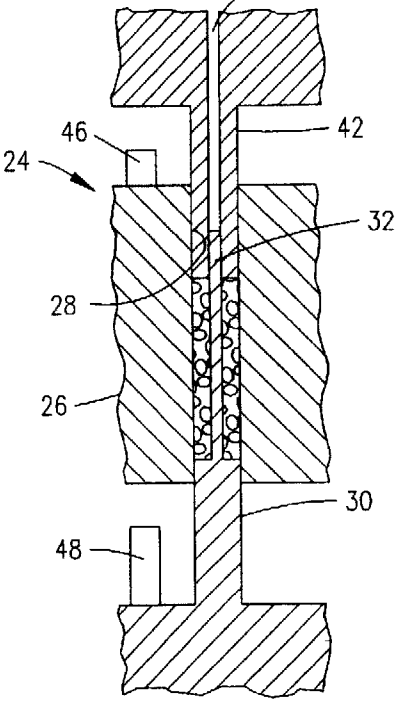
FIG. 5 is a schematic sectional view similar to FIG. 4 but showing the propellant measuring plate removed and the propellant components placed in the pellet forming die ready for compaction.
Figure 4:
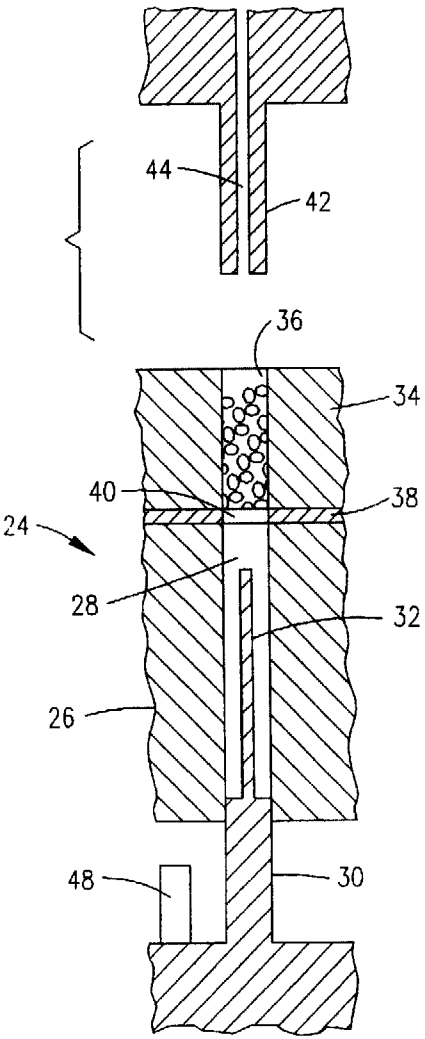
FIG. 4 is a schematic sectional view of a portion of a propellant measuring plate, a pellet forming die and associated parts thereof illustrating an initial stage of pellet formation.

In FIGS. 4, 5, and 6 I have illustrated a preferred procedure for manufacturing the pellet. Referring first to FIG. 4, reference numeral 24 includes a fragmentary portion of a multiple cavity pellet forming die 26 having a plurality of cavities or bores 28 (only one is shown). The cavity 28 is slightly tapered outwardly in diameter from the top to bottom for ease in removing a completed pellet out the bottom of the cavity. The degree of taper along the length of the pellet is preferably 0.008"/inch with the diameter at the upper end of the formed pellet being approximately 0.449" and at the lower end 0.455" with an average diameter of 0.452". The taper is introduced to assist in ready removal of the pellet downwardly from the cavity and not as a factor in use of the pellet.

A bottom punch 30 is designed to fit within and close off the bottom of cavity 28. Punch 30 carries an upwardly extending spindle 32 which extends axially upward within the cavity 28. Spindle 32 is slightly outwardly tapered from top to bottom to facilitate its removal from the pellet after the pressing step.

Located above the pellet forming die 26 is a propellant measuring plate (also termed shuffleboard) 34 which includes a plurality of propellant receiving bores or holes 36 (only one is shown). The propellant measuring plate 34 cooperates with a slide valve plate 38 interposed between the upper face of the pellet forming plate 26 and the bottom face of the propellant measuring plate 34. The valve plate 38 is provided with openings 40 (only one is shown) which can register with the measuring cavity 36 to allow propellant to drop into the die cavity 28, or be moved out of register so that the lower end of the measuring cavity 36 is closed by the slide valve 38.

The die cavity 28 is loaded by dispensing propellant as described. The loose propellant is, of course, loaded into the measuring cavity 36 by any suitable means. If desired, the Pyrodex® can first be loaded and then the ignition pad loaded on top. Alternatively, the blackpowder for the ignition pad can be first inserted followed by the Pyrodex for the main body 10. Sufficient solvent, water, or other fluid is added to the propellant to give it the desired pressing consistency. For this example, water is used at 1.5% added by weight.

It will be noted from FIG. 5 that the loose propellant, as it falls into the die cavity 28, is guided around the spindle 32 until the upper end of the spindle extends well above the top surface of the propellant.

Once the cavity 28 is properly loaded, the measuring plate 38 along with slide valve plate 34 are removed and an upper punch 42 is introduced axially downward into the die cavity 28 to contact the upper end of the propellant contained in the cavity 28. The upper punch 42 includes an axial passage 44 to receive the upper end portion of the spindle 32, allowing relative movement of the upper and lower punches toward one another thus to compact the propellant therebetween.

The degree of compaction of the propellant is controlled through the relative movement of the punches toward one another. One way of accomplishing this is by means of a removable limit stop 46 on the upper face of the pellet forming plate and a similar stop 48 on the punch assembly below the pellet forming plate. The stops are dimensioned to limit the maximum density to which the propellant grains are compacted which in turn controls the length of the pellet.

As shown in FIG. 6, compaction of the propellant takes place from both ends. This provides a desired uniformity of density at the end portions of the pellet 10. In the preferred embodiment, the compaction density of 333 grains/cu. in. is achieved.

Withdrawal of the lower punch and spindle permits the extraction of the completed pellet.

Rifles used to determine the ballistic performance of the pellets in this example are standard market rifles which have been equipped with pressure transducers and fired in a ballistic laboratory equipped to measure muzzle velocity. A standard group of five shots is fired preceded by a fouler shot. Laboratory technicians are skilled in their work, typically firing approximately 20,000 shots per year. The Thompson/Center Hawken is representative of the many muzzle loading rifles which have the hammer and nipple mounted on the side of the breech. The Modern Muzzleloader MK85 is fairly typical of the more modern inline-ignition type rifles.

Ballistic performance of the preferred pellet is given in Table 1 below:

TABLE 1

PELLET BALLISTIC PERFORMANCE

| RIFLE | PROJECTILE | NUMBER OF PELLETS | VELOCITY AVE. FPS | VELOCITY STD. DEV. FPS | NORMAL BREECH PRESSURE PSI |
|---|---|---|---|---|---|
| Thompson Center, Hawken | 490 Round Ball | One | 1270 | 62 | 4000 |
| Thompson Center, Hawken | 490 Round Ball | Two | 1800 | 30 | 12000 |
| Modern Muzzleloader, MK85 | Conical, 385 Grain | Two | 1420 | 13 | 15000 |
| Modern Muzzleloader, MK85 | Sabot, 260 Grain | One | 1072 | 50 | 5000 |
| Modern Muzzleloader, MK85 | Sabot, 260 Grain | Two | 1637 | 34 | 13000 |
| Modern Muzzleloader, MK85 | Sabot, 260 Grain | Three | 1971 | 42 | 20000 |

The following are other representative examples of unitary propellant pellets constructed in accordance with the foregoing principles.

EXAMPLE I

The pellet of Example I is similar to that described above with the exception that the two propellants are blended together prior to pressing. This second example yields a pellet which produces very similar ballistic performance to the pellet of the preferred embodiment. However, the ignition characteristics of this first example are not as good as those of the preferred embodiment. Production costs would be lower for this example, and for another choice of propellants, this premixing prior to pressing could be desirable.

For the sake of clarification, the tabulation below is given to summarize the similarities and differences for the two examples:

1. Pellet is for a 50 caliber rifle.
2. Pellet diameters are the same.
3. Weight of propellant is the same.
4. Both pellets have the same hole configuration.
5. Quantity of propellants is the same.
6. Pellet density is essentially the same. (A difference of 0.7%)
7. Pellet length is essentially the same. (A difference of 0.7%)
8. Pressing method is the same.
9. Pressing equipment is the same.
10. Pressing sequence is the same except that only one shuffleboard is needed.
11. Ballistic performance is as follows:

| | |
|---|---|
| Rifle | Modern Muzzleloader MK85 |
| Projectile | Sabot, 260 grain |
| Number of Pellets | Two |
| Average Velocity, fps | 1652 |
| Standard Deviation, fps | 14 |
| Nominal Breech Pressure, psi | 14000 |

EXAMPLE II

The pellet of Example II is again similar to those of the preferred pellet with the exception that the propellant is only blackpowder. This pellet again yields similar ballistic performance, but the fouling residue is increased over that of the preferred pellet.

For the sake of clarification, the tabulation below is given to summarize the similarities and differences between this example and the preferred embodiment:

1. Pellet is for a 50 caliber rifle.
2. Pellet diameters are the same.
3. Weight of propellant is 47 grains. The weight increase is necessary to achieve the desired ballistic performance because the blackpowder which has replaced the Pyrodex in the pellet is less energetic and more is required.
4. Pellets have the same hole configuration.
5. Only blackpowder with a 1.4% moisture content is used.
6. Pellet density for Example II is 376 grains/cu. in.
7. Pellet length is 0.847 inches.
8. Pressing method is the same.
9. Pressing equipment is the same.
10. Pressing sequence is the same except that only one shuffleboard is needed.
11. Ballistic performance is as follows:

| | |
|---|---|
| Rifle | Modern Muzzleloader MK85 |
| Projectile | Sabot, 260 grain |
| Number of Pellets | Two |
| Average Velocity, fps | 1560 |
| Standard Deviation, fps | 18 |
| Nominal Breech Pressure, psi | 11000 |

Note that the performance of the pellet from Example II is not as good as that from the preferred pellet and Example I. The reason is that blackpowder loses its energy more rapidly with increasing moisture content than does Pyrodex.

EXAMPLE III

The pellet from Example II had 1.4% moisture content. In this Example III, the pellet from Example II is dried to 0.5% moisture.

Ballistic performance is as follows:

| | |
|---|---|
| Rifle | Modern Muzzleloader MK85 |
| Projectile | Sabot, 260 grain |
| Number of Pellets | Two |
| Average Velocity, fps | 1624 |
| Standard Deviation, fps | 13 |
| Nominal Breech Pressure, psi | 13000 |

The dried pellet of Example III produced ballistic performance equivalent to the pellets of the preferred embodiment and Example I.

EXAMPLE IV

The pellet of Example IV is designed to work in a muzzle loading 45 caliber pistol. The procedure used to establish the necessary parameters and make the pellet is similar to that used for the rifle pellet in the preferred embodiment.

For the sake of clarification, the tabulation below is given to summarize the similarities and differences for this example as compared to the preferred embodiment:

1. Pellet is for a 45 caliber pistol.
2. Nominal pellet diameter is 0.411".
3. Weight of propellant is 30 grains. This weight of propellant will achieve the desired ballistic performance.
4. Experimentation has shown that this pellet does not require a hole to obtain good performance. Since only one pellet will be shot at a time, it is not necessary to provide the center axial ignition front as was done in the previous examples.
5. For this example, both propellants are moisturized to 1.5% water. The pellet uses the following amounts of propellant:
   Pyrodex: 25 grains by weight (approximately 35 grains by volume)
   Blackpowder: 5 grains by weight
   Total Propellant: 30 grains by weight
6. Pellet density for Example IV is 302 grains/cu. in. Since the pellet does not have an axial hole, structural strength for this pellet at this lower density is acceptable and ballistic performance is good.
7. Pellet length is 0.750".
8. Pressing method is the same.
9. Pressing equipment is the same.
10. Pressing sequence is the same.
11. A Ruger Old Army 45 caliber, cap and ball revolver was used for the ballistic testing.

Ballistic performance is as follows:

| | |
|---|---|
| Pistol | Ruger Old Army Revolver |
| Projectile | 0.457" Round Ball |
| Number of Pellets | One |
| Average Velocity, fps | 1106 |
| Standard Deviation, fps | 44 |
| Nominal Breech Pressure, psi | Not Determined |

EXAMPLE V

The pellet of Example V is made from a propellant belonging to the family of propellants which use as fuels ascorbic acid, erythorbic acid, or derivatives of these acids. The oxidizers normally include potassium nitrate and sometimes potassium perchlorate. These propellants have good ignition properties, and an igniter propellant such as blackpowder is not necessary. These propellants are hygroscopic and require treatment to protect them against moisture intrusion. Advantages of the use of this family of propellants is that the fouling residue produced by the propellant is mostly water soluble, and lower breech pressures develop.

For the sake of clarification, the tabulation below is given to summarize the similarities and differences between this example and the preferred embodiment:

1. Pellet is for a 50 caliber rifle.
2. Pellet diameters are the same.
3. Weight of propellant is 45 grains.
4. Pellets have the same hole configuration.
5. As stated previously, only the ascorbic acid type propellant is used. It had a moisture content of 0.1%.
6. Pellet density is 395 grains/cu. in.
7. Pellet length is 0.765 inches.
8. Pressing method is the same.
9. Pressing equipment is the same.
10. Pressing sequence is the same except that only one shuffleboard is needed.
11. Ballistic performance is as follows:

| | |
|---|---|
| Rifle | Modern Muzzleloader MK85 |
| Projectile | Sabot, 260 grain |
| Number of Pellets | Two |
| Average Velocity, fps | 1462 |
| Standard Deviation, fps | 34 |
| Nominal Breech Pressure, psi | 7000 |

As the foregoing example suggests, propellants in the form of blackpowder substitutes other than Pyrodex may be used for formulation of the pellet without departing from the invention. It is also to be noted that in any of the preceding examples, the propellants can be treated with a suitable moisture proofing compound. Examples are Surface Treated Cabosil TS-720 or TS-530 or Dow Corning 1107 fluid with or without a suitable catalyst.

From the foregoing it will be seen that this invention is one well adapted to attain all end and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A unitary, solid pre-formed propellant pellet for use in muzzle loading firearms having a flash channel, said pellet being substantially cylindrical in shape and having a maximum diameter such that the pellet will pass freely down the bore of the firearm for which it is intended and avoid pushing of combustion residue from a previous firing into the flash channel of the firearm.

2. A pellet as in claim 1, in which the maximum diameter of said pellet ranges from approximately 0.005 inch to 0.100 inch less than the diameter of said bore.

3. A unitary, solid pre-formed propellant pellet for use in muzzle loading firearms having a flash channel, said pellet being substantially cylindrical in shape and having a maximum diameter such that the pellet will pass freely down the bore of the firearm for which it is intended and avoid pushing of combustion residue from a previous firing into the flash channel of the firearm, said pellet being composed of a blackpowder substitute, and including an axial pad integral with the pellet and formed of blackpowder.

4. A pellet as in claim 3 in which said blackpowder substitute is Pyrodex®.

5. A pellet as in claim 1 in which the average density of the pellet is such as to provide a burning rate which will generate propellant gases to propel a projectile at predetermined muzzle velocities with breech pressures that are within the safety limits of the firearm and without having unburned particles exiting the muzzle.

6. A pellet as in claim 5 in which the average density is in the range of approximately 320 grains/cu. in. to approximately 410 grains/cu. in.

7. A pellet as in claim 1 or claim 3 in which the pellet is formed with an axial bore open at opposite ends of the pellet.

8. A pellet as in claim 7, in which the diameter of the bore is approximately 0.125 inches.

9. A pellet as in claim 1, the maximum density of said pellet being located axially adjacent the opposite ends and decreasing from each end toward the axial mid point.

* * * * *

UNITED STATES PATENT AND TRADEMARK OFFICE

CERTIFICATE OF CORRECTION

PATENT NO. : 5,726,378

DATED : March 10, 1998

INVENTOR(S) : G. Dean Barrett

It is certified that error appears in the above-identified patent and that said Letters Patent is hereby corrected as shown below:

Column 3, line 44 "exampled" should read --example;--.

Column 5, line 22 "NORMAL" should read --NOMINAL--.

Signed and Sealed this

Sixteenth Day of March, 1999

*Attest:*

*Attesting Officer*

Q. TODD DICKINSON

*Acting Commissioner of Patents and Trademarks*